US006850723B2

(12) United States Patent
Lee et al.

(10) Patent No.: US 6,850,723 B2
(45) Date of Patent: Feb. 1, 2005

(54) CONTACT SHOCK DAMPENING AND DEVELOPMENT NIP FORMING APPARATUS FOR DEVELOPERS

(75) Inventors: Jin-soo Lee, Suwon (KR); Se-hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/443,063

(22) Filed: May 22, 2003

(65) Prior Publication Data

US 2004/0001729 A1 Jan. 1, 2004

(30) Foreign Application Priority Data

Jun. 28, 2002 (KR) ..... 2002-0037128

(51) Int. Cl.[7] ..... G03G 15/01; G03G 15/08
(52) U.S. Cl. ..... 399/228; 399/113; 399/119
(58) Field of Search ..... 399/228, 223, 399/222, 119, 159, 107, 113

(56) References Cited

U.S. PATENT DOCUMENTS 5,930,575 A * 7/1999 Fornalik et al. ..... 399/345
6,070,031 A * 5/2000 Haneda et al. ..... 399/113 X
6,079,732 A * 6/2000 Nakajima et al. ..... 280/728.2
6,694,118 B2 * 2/2004 Yoo ..... 399/228
2002/0110386 A1 * 8/2002 Kanno et al. ..... 399/228 X
2003/0007808 A1 * 1/2003 Hiroki ..... 399/228
2003/0147672 A1 * 8/2003 Ahn ..... 399/228

FOREIGN PATENT DOCUMENTS

JP 63-058469 * 3/1988
JP 01-225974 * 9/1989
JP 03-163576 * 7/1991
JP 04-025866 * 1/1992
JP 08-335023 * 12/1996
JP 10-326044 * 12/1998

* cited by examiner

*Primary Examiner*—Sophia S. Chen
(74) *Attorney, Agent, or Firm*—Staas & Halsey LLP

(57) ABSTRACT

A contact shock dampening and development nip forming apparatus for developers includes a unit to dampen a contact shock and to form a development nip installed on both ends of a developing roller to be disposed between a photosensitive body and the developing roller. Accordingly, the contact shock dampening and development nip forming apparatus absorbs shocks applied to the photosensitive body from the developing roller upon changing the developers, to thereby protect the photosensitive layer of the photosensitive body and extend the lifespan of the photosensitive body. The apparatus also maintains a thickness of the development nip to thereby obtain a steady image quality, even though the developing roller and/or the photosensitive body may be formed of solid substances.

20 Claims, 4 Drawing Sheets

CONTACT SHOCK DAMPENING AND DEVELOPMENT NIP FORMING APPARATUS FOR DEVELOPERS

CROSS-REFERENCE TO RELATED APPLICATIONS

This application claims the benefit of Korean Application No. 2002-37128, filed Jun. 28, 2002, in the Korean Intellectual Property Office, the disclosure of which is incorporated herein by reference.

BACKGROUND OF THE INVENTION

1. Field of the Invention

The present invention relates to an office machine such as a color photocopier, color printer, etc., having plural electrophotographic developers, and more particularly, to a contact shock dampening and development nip forming apparatus for developers which dampens contact shocks occurring when color developing rollers come in contact with the photosensitive drum, and maintains a thickness of the development nip.

2. Description of the Related Art

In general, an electrophotographic color image forming apparatus 10 (see FIG. 1), such as a color photocopier, color printer, etc., has a drum-shaped photosensitive body 11 continuously rotating in one direction due to a photosensitive body driving source (not shown). Adjacent to the circumference of the photosensitive body 11 is a first charger 12, a laser scanning unit (LSU) 20, and four contact development-type developers 31, 32, 33, and 34 accommodating yellow, magenta, cyan, and black developing agents. The apparatus 10 also includes a transfer roller 60, a discharge lamp 87, and a cleaning discharger 80, respectively in predetermined locations.

The first charger 12 is a scorotron charger and uniformly charges the photosensitive body 11, and the LSU 20 exposes the photosensitive body 11 to laser light in an axial direction to form a line.

Each of the developers 31, 32, 33, and 34 has a developing roller 13, a developing agent container 16, a developing agent supply roller 15, and a developing agent layer thickness regulation member 51 regulating the thickness of a developing agent attached on the developer 13. The developers 31, 32, 33 and 34 are each rotated by a developer driving source (not shown). The developing agent is supplied to the developing roller 13 through the developing agent supply roller 15 of the developing agent container 16, and regulated into a thin layer on the developing roller 13 by the developing agent layer thickness regulation member 51.

The respective developers 31, 32, 33, and 34 are reciprocated in a developer guide member (not shown), and move against release springs 74 toward the photosensitive body 11 by cams 35, 36, 37, and 38 fixed to rotation shafts 56. The rotation of the rotation shafts 56 is regulated by electronic clutches (not shown).

Further, the developing roller 13 is applied with a developing bias voltage upon development. The developing bias voltage has the same polarity as the photosensitive body 11 if the development involves negative-positive reversal.

The transfer roller 60 electrostatically transfers onto a sheet of recording paper a color image formed on the photosensitive body 11, and the cleaning discharger 80 removes developing agents remaining on the photosensitive body 11.

In the operation of the image forming apparatus 10, first, when a printing command is input, the photosensitive body 11 continuously rotates due to the photosensitive driving source. Thereby, the surface of the photosensitive body 11 is uniformly charged by the first charger 12. When a charged region is reached, for example, on a developing location d of the yellow developer 31 for a first color image, the electronic clutch of the yellow developer 31 is electrically engaged, so that the yellow developer 31 moves toward the photosensitive body 11 by the eccentric cam 35. The developer 31 is thus set in a developing state.

Next, the surface of the photosensitive body 11 is exposed to light from the LSU 20 to form a yellow electrostatic latent image thereon, and at the developing location d a yellow image is continuously developed from the leading end to the rear end of the image.

After the yellow image is completely formed and the rear end of the image passes through the developing location d, the eccentric cam 35 rotates, and thereby the yellow developer 31 is separated from the photosensitive body 11.

Thereafter, when the leading end of the image is reached, for example, on the developing location e of the magenta developer 32 for a second color image, the electronic clutch of the magenta developer 32 is electrically engaged, so that the magenta developer 32 is set in the developing state by the eccentric cam 36.

At this time, the yellow image formed on the photosensitive body 11 passes through the transfer roller 60, the discharge lamp 87, and the cleaner discharger 80, which are maintained in a non-operation state, and is again positioned underneath the first charger 12. In particular, the transfer roller 60 and the cleaning discharger 80 are generally set in a state of non-contact with the photosensitive body 11. However, contact is necessary to prevent fading of the image.

Underneath the first charger 12, the photosensitive body 11 having the yellow image is evenly charged by the first charger 12 again, and then a latent image corresponding to the magenta color is superimposed on the yellow image by exposing the photosensitive body 11 to light from the LSU 20, and developed on the magenta developing location e. After the magenta image is completely formed and the rear end of the image passes through the magenta developing location e, the eccentric cam 36 rotates, so that the magenta developer 32 is separated from the photosensitive body 11.

Next, when the rear end of the image is reached, for example, on a developing location f of the cyan developer 33 for a third color image to be formed, the electronic clutch of the cyan developer 33 is electrically engaged so that the cyan developer 33 is set in the developing state by the eccentric cam 37.

At this time, the superimposed image of yellow and magenta have passed through the transfer roller 60, the discharge lamp 87, and the cleaner discharger 80 is again located underneath the first charger 12. Thus, the photosensitive body 11 is evenly charged by the first charger 12. Further, the image of yellow and magenta is superimposed with the cyan image by exposure to light from the LSU 20. The cyan image is developed on the cyan developing location f. After the cyan image is completely formed and the rear end of the image passes through the cyan developing location f, the eccentric cam 37 rotates so that the cyan developer 33 is separated from the photosensitive body 11.

Next, a black image is superimposed and formed in the same manner, so that all of the images are completely formed. The color image formed on the photosensitive body 11 is transferred onto a sheet of recording paper P synchronously delivered from a paper supply unit (not shown) by the transfer roller 60.

After the transfer, the photosensitive body 11 is discharged by the discharge lamp 87, the developing agent remaining on the surface of the photosensitive body 11 is removed by a rotation brush 81 of the cleaning discharger 80, so that the photosensitive body 11 returns to the initial state. At this time, the paper P on which the image is transferred is delivered to a fixing unit (not shown) to be fixed, and is externally discharged.

As described above, the conventional image forming apparatus 10 has a structure in which the developing rollers 13 of the four color developers 31, 32, 33, and 34 come in contact with the photosensitive body 11 for development. Thus, the photosensitive body 11 performs four complete developing processes, one for every color. The developing rollers 13 of the respective developers 31, 32, 33, and 34 come in or out of contact with the photosensitive body 11 due to pressure from the eccentric cams 35, 36, 37, and 38 to be in a developing or a waiting position.

However, the conventional photosensitive body 11 is generally constructed with a cylindrical member having a high hardness, such as aluminum, having a photosensitive layer coated on the outer circumference thereof. Further, the developing rollers 13 are also constructed with cylindrical members of high hardness, such as aluminum or resin. Accordingly, the contact shocks occurring when the photosensitive body 11 performs the developing processes in contact with the developing rollers 13 of the developers 31, 32, 33, and 34 are directly transferred to the entire photosensitive body 11. Thus, the quality of images developed on the photosensitive body 11 becomes unstable.

Further, a pressure variation occurring when the developing rollers 13 come in or out of contact with the photosensitive body 11 due to the eccentric cams 35, 36, 37, and 38 for switching to the next developers 31, 32, 33, 34 upon developing is directly transferred to the photosensitive body 11. This occurs during different operations, for example, charging or exposing to light. Furthermore, damage to the photosensitive layer of the photosensitive body 11 may result, thereby causing a problem in which the quality of images developed on the photosensitive body 11 is deteriorated. Also, the life span of the photosensitive body 11 is shortened.

SUMMARY OF THE INVENTION

Accordingly, it is an aspect of the present invention to solve the above and/or other problems.

It is another aspect of the present invention to provide a contact shock dampening and development nip forming apparatus for developers which enables developing rollers to stably contact a photosensitive body upon developing to prevent the photosensitive body from being damaged due to shocks applied when the developing rollers come in and out of contact with the photosensitive body. Thus, the life span of the photosensitive body is extended and stable image quality is obtained.

It is another aspect of the present invention to provide a contact shock dampening and development nip forming apparatus for developers which allows a certain development gap to be maintained between the developing rollers and the photosensitive body upon developing, to thereby obtain a stable image quality.

Additional aspects and advantages of the invention will be set forth in part in the description which follows and, in part, will be obvious from the description, or may be learned by practice of the invention.

The foregoing and/or other aspects of the present invention are achieved by providing a contact shock dampening and development nip forming apparatus for use in an electrophotographic image forming device having a developer, a photosensitive body to form electrostatic latent images on a surface thereof, and a developing agent transfer body rotating in contact with the photosensitive body to attach a developing agent onto the electrostatic latent images formed on the photosensitive body to form visual images, including a dampening/forming unit to dampen a contact shock and form a development nip, installed on both ends of the photosensitive body and the developing agent transfer body and disposed between the photosensitive body and the developing agent transfer body, a portion of a circumferential surface thereof having an outer diameter larger than an outer diameter of the photosensitive body and the developing agent transfer body, a difference between the outer diameters being the same as a thickness of the transfer nip to thereby dampen contact shocks and form the development nip.

The contact shock dampening and development nip forming unit may include two small rollers, each of which has a cylindrical body disposed on one of the both ends of the developing agent transfer body, and having a non-conductive elastic rubber layer formed on an outer surface of the cylindrical body.

The cylindrical body may be formed as a separate part from the developing agent transfer body to have the same outer diameter as the developing agent transfer body; and the elastic rubber layer seat is formed by a double injection molding in an elastic rubber layer groove formed in the outer surface of the cylindrical body in a circumferential direction.

At this time, the elastic rubber layer may be inserted as a separate part, rather than formed by the double injection molding, in the elastic rubber layer seat groove formed in the outer surface of the cylindrical body in a circumferential direction.

Alternatively, the cylindrical body can be formed in one body with the developing agent transfer body to have the same outer diameter as the developing agent transfer bodies, and the elastic rubber layer can be formed by a double injection molding in an elastic rubber layer seat groove formed in the outer surface of the cylindrical body in a circumferential direction. At this time, the elastic rubber layer may be inserted as a separate part, rather than being formed by the double injection molding, in the elastic rubber layer seat groove formed in the outer surface of the cylindrical body in a circumferential direction.

Further, the extent of dampening and a thickness of a development nip between the photosensitive body and the developing agent transfer body may be adjusted by a thickness of the elastic rubber layer protruding from the outer surface of the cylindrical body further than the outer diameter of the developing agent transfer body.

Alternatively, the dampening extent and the development nip thickness between the photosensitive body and the developing agent transfer bodies may be adjusted by a hardness of the elastic rubber layer protruding from the outer surface of the cylindrical body more than the outer diameter of the developing agent transfer body.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
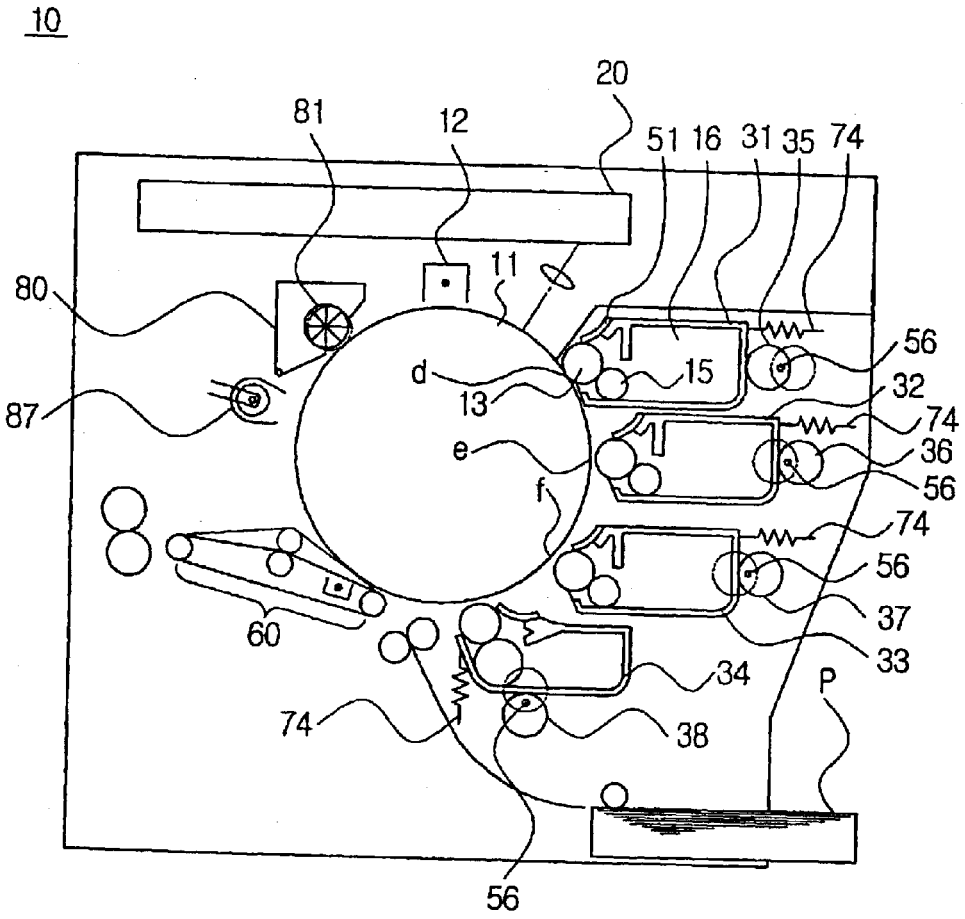
FIG. 1 (PRIOR ART)
FIG. 1 is a drawing schematically showing a conventional color image forming apparatus.

Reference will now be made in detail to the present preferred embodiments of the present invention, examples of which are illustrated in the accompanying drawings, wherein like reference numerals refer to like elements throughout.

Figure 2:
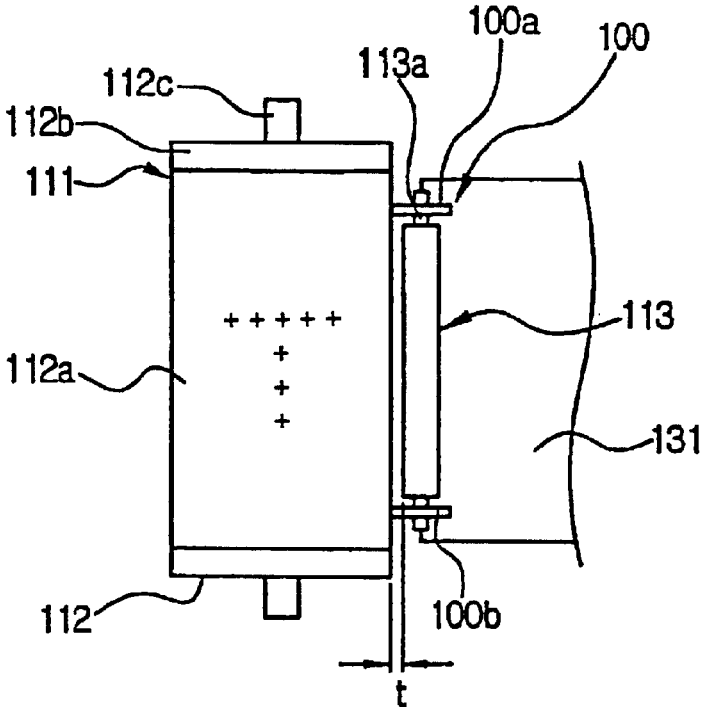
FIG. 2 is a plan view schematically showing a developer and a photosensitive body with a contact shock dampening and development nip forming apparatus according to an embodiment of the present invention.

In FIG. 2, partially illustrated is a developer 131 and a photosensitive body 111 of a color image forming device to which a contact shock dampening and development nip forming apparatus 100 is applied.

Such a color image forming device has the cylindrical drum-shaped photosensitive body 111 to form electrostatic latent images (such as the letter 'T' shown in FIG. 2) by using potential characteristics of the surface thereof, and the four contact development-type developers 131 (only one is shown in FIG. 2), each having a developing roller 113 playing a role of a developing agent transfer body, to attach a developing agent on electrostatic latent images formed on the photosensitive body 111 while rotating in contact with the photosensitive body 111 to form visual images. Although the electrostatic latent image is shown as being formed of positive charges, it may also be formed of negative charges.

The photosensitive body 111 includes a pipe or cylinder 112, which is made of metal, for example, aluminum. The cylinder 112 has a shaft 112*c*, and a photosensitive layer 112*a* coated in a certain thickness on the outer surface of the cylinder 112, except for non-photosensitive layer portions 112*b* of both edges of the cylinder 112.

The developing roller 113 of the developer 131 is structured with a cylinder or a cylindrical tube formed of metal such as aluminum, or conductive plastics, and having a shaft 113*a*.

The constituents of the developer 131, except for the developing roller 113, may be the same as those of the developers 31, 32, 33, and 34 of the color image forming apparatus 10 shown in FIG. 1. Thus, detailed descriptions thereof will be omitted.

On both ends of the shaft 113*a* is formed the contact shock dampening and development nip forming apparatus 100. When the developing roller 113 moves to contact the photosensitive body 111 in order to develop corresponding colors, the apparatus 100 rotates while dampening contact shocks and at the same time forming a development nip of a certain thickness to maintain a stable development quality between the developing roller 113 and the photosensitive body 111.

The contact shock dampening and development nip forming apparatus 100 includes rollers 100*a* and 100*b* to dampen contact shocks and form the development nip installed on both ends of the developing roller 113. The rollers 100*a* and 100*b* have an outer diameter which is greater than an outer diameter of the developing roller 113. This difference in size is equal to the predetermined thickness (t) of the development nip, to thereby dampen the contact shocks.

Figure 3A:
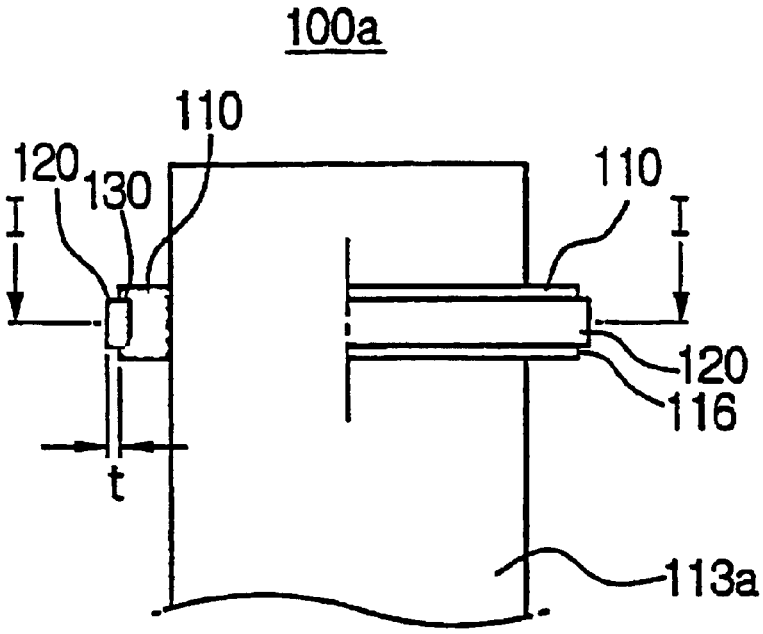
FIG. 3A is a partial sectional view showing the contact shock dampening and development nip forming apparatus shown in FIG. 2.
Figure 3B:
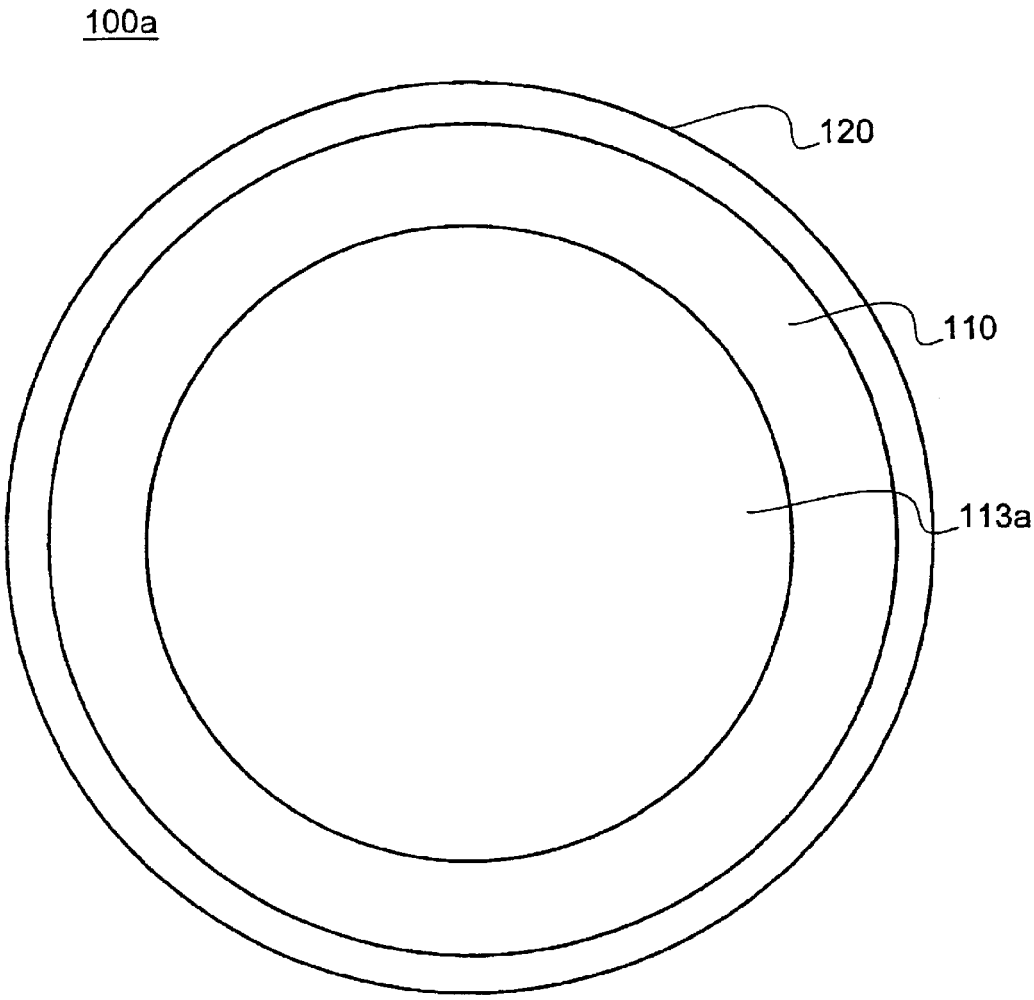
FIG. 3B is a sectional view taken along I—I of FIG. 3A.

As shown in FIG. 3A and FIG. 3B, the apparatus 100 includes the two rollers 100*a*, 100*b*, each having a non-conductive cylindrical body 110 formed of plastics such as polycarbonate PC, polyacetal, and so on. The rollers 100*a*, 100*b* are disposed on the ends of the shaft 113*a*, and a non-conductive elastic rubber layer 120 formed on the outer surface of the cylindrical body 110.

Each of the cylindrical bodies 110 has the same outer diameter as the developing roller 113, and is tightly fitted into the shaft 113*a* of the developing roller 113.

Further, the cylindrical body 110 has an elastic rubber layer seat groove 130 to form the elastic rubber layer 120 in the circumferential direction of an outer surface 116 thereof.

The elastic rubber layer 120 may be formed by a double injection molding in the elastic rubber layer seat groove 130, but also may be inserted in the elastic rubber layer seat groove 130 as a separate part.

Alternatively, the cylindrical body 110 can be formed in one body with the developing roller 113 or the shaft 113*a* having the same outer diameter as the developing roller 113. In this case, an elastic rubber layer seat groove (not shown) is formed in the outer surface of a cylindrical body (not shown) to form an elastic rubber layer (not shown). This is similar to the forming of the separate part from the developing roller 113. The elastic rubber layer is formed by the double injection molding or is inserted as a separate part in the elastic rubber layer seat groove.

In either case, the thickness t of the elastic rubber layer 120 formed in the elastic rubber layer seat groove 130, and protruded from the outer surface 116 of the cylindrical body 110, is adjusted to form a development nip of a certain thickness which can dampen shocks due to contact with the photosensitive body 111, and uniformly and stably maintain the development quality. This is possible even when the developing roller 113 moves into contact with the photosensitive body 111.

As above, the extent of shock dampening and the thickness t may be adjusted by the thickness of the elastic rubber layer 120, and also by a hardness of the elastic rubber layer 120.

Accordingly, the contact dampening and development nip forming apparatus 100 dampens contact shocks with the elastic rubber layer 120 and allows the developing roller 113 to be in contact with the photosensitive body 111 with a certain pressure when the developing roller 113 is attached to or detached from the photosensitive body 111. A development nip of a certain thickness t is maintained. This prevents damage to and peeling of the photosensitive layer of the photosensitive body 111. This occurs even though the photosensitive body 111, and the developing roller 113 are formed of hard materials such as plastics or metal substances.

Further, since the elastic rubber layer 120 and/or the cylindrical body 110 are made of non-conductive materials, the electrostatic clinging of the developing agent can be prevented. Accordingly, the problem of image defects due to contamination of the contact shock dampening and development nip forming apparatus 100 is prevented.

As described above, the contact shock dampening and development nip forming apparatus 100 is mounted on both ends of the shaft 113*a*. However, the apparatus 100 may also be installed on both ends of the photosensitive body 111.

The operation of the contact shock dampening and development nip forming apparatus 100 is similar to that of the apparatus 10 of FIG. 1. One exception is that the contact shock dampening and development nip forming apparatus 100 dampens the contact shocks.

As described above, even though the developing roller and/or the photosensitive body are formed of solid substances, the contact shock dampening and development nip forming apparatus for developers absorbs shocks through the elastic rubber layer. Thus, the photosensitive layer of the photosensitive body is protected, which extends the life span of the photosensitive body.

Further, the contact shock dampening and development nip forming apparatus for developers according to the embodiment of the present invention maintains a development nip of a certain thickness between the developing roller and the photosensitive body, to thereby obtain a stable image quality.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A contact shock dampening and development nip forming apparatus for use in an electrophotographic image forming device having a developer, a photosensitive body to form electrostatic latent images on a surface thereof, and a developing agent transfer body rotating in contact with the photosensitive body to attach a developing agent onto the electrostatic latent images formed on the photosensitive body to form visual images, comprising:

a dampening/forming unit to dampen a contact shock to the photosensitive body from the developing agent transfer body and form a development nip, installed on both ends of the photosensitive body and the developing agent transfer body and disposed between the photosensitive body and the developing agent transfer body, a portion of a circumferential surface thereof having an outer diameter larger than an outer diameter of the photosensitive body and the developing agent transfer body, a difference between the outer diameters being the same as a thickness of the development nip to thereby dampen contact shocks and form the development nip.

2. The contact shock dampening and development nip forming apparatus as claimed in claim 1, wherein the dampening/forming unit comprises two rollers, disposed on opposite ends of the developing agent transfer body, the rollers each comprising:

a cylindrical body; and a non-conductive elastic rubber layer formed on an outer surface of the cylindrical body.

3. The contact shock dampening and development nip forming apparatus as claimed in claim 2, wherein each of the cylindrical bodies is separate from the developing agent transfer body and has an outer surface having a same outer diameter as the diameter of the developing agent transfer body, and the elastic rubber layer is formed by a double injection molding in an elastic rubber layer seat groove formed in the outer surface of the cylindrical body in a circumferential direction.

4. The contact shock dampening and development nip forming apparatus as claimed in claim 2, wherein each of the cylindrical bodies is separate from the developing agent transfer body and has an outer surface having a same outer diameter as the diameter of the developing agent transfer body, and the elastic rubber layer is formed separately from the cylindrical body and is inserted in an elastic rubber layer seat groove formed in the outer surface of the cylindrical body in a circumferential direction.

5. The contact shock dampening and development nip forming apparatus as claimed in claim 2, wherein each of the cylindrical bodies has an outer surface having a same outer diameter as the diameter of the developing agent transfer body, and is unitary with the developing agent transfer body, and the elastic rubber layer is formed by a double injection molding in an elastic rubber layer seat groove formed in the outer surface of the cylindrical body in a circumferential direction.

6. The contact shock dampening and development nip forming apparatus as claimed in claim 2, wherein each of the cylindrical bodies is unitary with the diameter of the developing agent transfer body and has a same outer diameter as the developing agent transfer body, and the elastic rubber layer is formed separately from the cylindrical body and is inserted in an elastic rubber layer seat groove formed in the outer surface of the cylindrical body in a circumferential direction.

7. The contact shock dampening and development nip forming apparatus as claimed in claim 2, wherein an extent of the dampening and the thickness of the development nip is adjusted by a thickness of the elastic rubber layer, the elastic rubber layer protruding from the outer surface of the cylindrical body beyond the outer diameter of the developing agent transfer body.

8. The contact shock dampening and development nip forming apparatus as claimed in claim 2, wherein an extent of the dampening and the thickness of the development nip are adjusted by a hardness of the elastic rubber layer, the elastic rubber protruding layer from the outer surface of the cylindrical body beyond the outer diameter of the developing agent transfer body.

9. An apparatus comprising:

a first body having an electrostatic image formed thereon;

a second body to contact the first body and form a nip therebetween, to develop the electrostatic image; and a dampening unit to contact the second body and the first body, to absorb a contact shock from the second body to the first body.

10. The apparatus as claimed in claim 9, wherein the second body has a diameter, the dampening unit has a diameter, and the nip has a thickness equal to a difference between the diameters of the second body and the dampening unit.

11. The apparatus as claimed in claim 10, wherein the second body is a roller having a shaft, and the dampening unit comprises a cylinder on the shaft.

12. The apparatus as claimed in claim 11, wherein the second body further comprises a plurality of the shafts on opposite ends of the roller, and the dampening unit further comprises a plurality of the cylinders respectively on the shafts.

13. The apparatus as claimed in claim 11, wherein the cylinder is non-conductive.

14. The apparatus as claimed in claim 13, wherein the cylinder is formed of a plastic.

15. The apparatus claimed in claim 14, wherein the dampening unit further comprises a non-conductive rubber layer on an outer circumference of the cylinder.

16. The apparatus as claimed in claim 15, wherein a diameter of the cylinder is equal to a diameter of the second body.

17. The apparatus as claimed in claim 15, wherein a thickness of the rubber layer controls the thickness of the developing nip.

18. The apparatus as claimed in claim 15, wherein a hardness of the rubber layer controls the thickness of the developing nip.

19. An apparatus comprising:

a first rotating body having an electrostatic image formed thereon;

a second rotating body to rotate with the first body and form a developing nip therebetween to develop the electrostatic image; and a forming unit comprising:

a cylinder to rotate with the second body, and an elastic layer on a circumference of the cylinder to contact the first body, a thickness or hardness of the elastic layer determining a thickness of the developing nip.

20. An apparatus comprising:

a plurality of first bodies having electrostatic images formed thereon;

a plurality of second bodies to respectively contact the first bodies to form contact nips therebetween, to develop the electrostatic images with developers of different colors; and a plurality of dampening units to respectively contact the first and second bodies, to absorb contact shocks from the second bodies to the first bodies.

* * * * *